313-414 SR
5/20/86 OR 4,590,402

United States Patent [19]

Alig

[11] Patent Number: 4,590,402

[45] Date of Patent: May 20, 1986

[54] COLOR PICTURE TUBE HAVING AN IMPROVED EXPANDED FOCUS LENS TYPE INLINE ELECTRON GUN

[75] Inventor: Roger C. Alig, West Windsor Township, Mercer County, N.J.

[73] Assignee: RCA Corporation, Princeton, N.J.

[21] Appl. No.: 646,095

[22] Filed: Aug. 31, 1984

[51] Int. Cl.[4] ..... H01J 29/50; H01J 29/62

[52] U.S. Cl. ..... 313/414; 313/449; 313/460

[58] Field of Search ..... 313/414, 449, 460, 458, 313/412, 409

[56] References Cited

U.S. PATENT DOCUMENTS

| | | | |
|---|---|---|---|
| 3,873,879 | 3/1975 | Hughes | 315/13 C |
| 4,370,592 | 1/1983 | Hughes et al. | 313/414 |
| 4,388,552 | 6/1983 | Greninger | 313/414 |
| 4,400,649 | 8/1983 | Chen | 313/414 |

FOREIGN PATENT DOCUMENTS 51-52668 4/1976 Japan .

*Primary Examiner*—David K. Moore

*Assistant Examiner*—K. Wieder

*Attorney, Agent, or Firm*—Eugene M. Whitacre; Dennis H. Irlbeck

[57] ABSTRACT

An improved color picture tube has an inline electron gun for generating and directing three electron beams, a center beam and two side beams, along coplanar paths toward a screen of the tube. The gun includes a main focusing lens for focusing the electron beams. The main focusing lens is formed by two spaced electrodes, each having three separate inline apertures therein. Each electrode also includes a peripheral rim. The peripheral rims of the two electrodes face each other. The apertured portion of each electrode is within a recess set back from the rim. The recesses of the electrodes have substantially the same dimension perpendicular to the inline directions of the inline apertures as the dimension parallel to the inline direction of the inline apertures. However, the recesses have lesser dimensions along diagonals angled at approximately 45 degrees with respect to the inline direction of the inline apertures. The electrodes are connected by four support rods that are peripherally attached to the electrodes along the diagonals.

3 Claims, 11 Drawing Figures

COLOR PICTURE TUBE HAVING AN IMPROVED EXPANDED FOCUS LENS TYPE INLINE ELECTRON GUN

BACKGROUND OF THE INVENTION

The present invention relates to color picture tubes having improved inline electron guns and particularly to such guns having an improved expanded focus lens for reduced spherical aberration.

An inline electron gun is one designed to generate or initiate preferably three electron beams in a common plane and direct those beams along convergent paths to a point or small area of convergence near the tube screen. In one type of inline electron gun, shown in U.S. Pat. No. 3,873,879, issued to R. H. Hughes on March 25, 1975, the main electrostatic focusing lens for focusing the electron beams is formed between two electrodes referred to as the first and second accelerating and focusing electrodes. These electrodes include two cup-shaped members having their bottoms facing each other. Three apertures are included in each cup bottom to permit passage of three electron beams and to form three separate main focusing lenses, one for each electron beam. In a preferred embodiment, the overall diameter of the electron gun is such that the gun will fit into a 29 mm tube neck. Because of this size requirement, the three focusing lenses are very closely spaced from each other, thereby providing a severe limitation on focusing lens design. It is known in the art that the larger the focusing lens diameter, the less will be the spherical aberration which restricts the focusing quality.

In addition to the focusing lens diameter, the spacing between focusing lens electrode surfaces is important, because greater spacing provides a more gentle voltage gradient in the lens, which also reduces spherical aberration. Unfortunately, greater spacing between electrodes beyond a particular limit (typically 1.27 mm) generally is not permissible because of beam bending from electrostatic charges on the neck glass penetrating into the space between the electrodes, which causes electron beam misconvergence.

In U.S. Pat. No. 4,370,592, issued to R.H. Hughes and B. G. Marks on January 25, 1983, an electron gun is described wherein the main focusing lens is formed by two spaced electrodes. Each electrode includes a plurality of apertures therein, equal to the number of electron beams, and also a peripheral rim, with the peripheral rims of the two electrodes facing each other. The apertured portion of each electrode is located within a recess set back from the rim. The effect of this main focusing lens is to provide the gentle voltage gradient sought to reduce spherical aberration. Because of the asymmetrical shape of the peripheral rims of the two electrodes described in the patent, horizontal and vertical focus voltage components for the inner and outer guns are not the same. In the vertical direction, the center electron beam sees more of a slot and experiences more focusing action than do the side electron beams, whereat the focusing geometry is bounded, in part, by a circular arc. This is because the field penetrates the slot more easily than an inscribed circular boundary in he vertical direction. Likewise, the horizontal focusing component at the outer electron beams may be more active than at the center beam, because the field in the horizontal direction falls away more rapidly at the sides of the peripheral rims than within the center of the recessed cavity. A focusing electrode as disclosed in the cited U.S. Pat. No. 4,370,592 is shown in FIG. 5 hereof and discussed with respect thereto below.

Two other patents disclose modified shapes of the peripheral rims and recesses to at least partially compensate for the difference between horizontal and vertical focusing strengths caused by the elongated shape of the rims and recesses. One of these patents is U.S. Pat. No. 4,388,552, issued to P. T. Greninger on June 14, 1982. A focusing electrode as disclosed therein is shown in FIG. 6 hereof and described with respect thereto. The second patent is U.S. Pat. No. 4,400,649, issued to H.-Y. Chen on Aug. 23, 1983. A focusing electrode as disclosed in this latter patent is shown in FIG. 7 hereof and described with respect thereto.

Although the above-cited patents disclose electron gun designs having decidedly improved performance over prior art inline electron guns, it is desirable to further improve such gun designs to reduce the differential in strengths between the horizontal and vertical focusing fields and to enlarge the recesses in their focusing electrodes, thereby enlarging their main focusing lenses. Such enlargement of the recesses, however, is greatly limited by the design of the aforementioned prior art electron guns because of their use of two large electrode support rods or beads.

SUMMARY OF THE INVENTION

In accordance with the present invention, improved color picture tube has an inline electron gun for generating and directing three electron beams, a center beam and two side beams, along coplanar paths toward a screen of the tube. The gun includes a main focusing lens for focusing the electron beams. The main focusing lens is formed by two spaced electrodes, each having three separate inline apertures therein. Each electrode also includes a peripheral rim. The peripheral rims of the two electrodes face each other. The apertured portion of each electrode is within a recess set back from the rim. The recesses of the electrodes have substantially the same dimension perpendicular to the inline direction of the inline apertures as the dimension parallel to the inline direction of the inline apertures. However, the recesses have lesser dimensions along diagonals angled at approximately 45 degrees with respect to the inline direction of the inline apertures.

In a preferred embodiment, the electrodes are connected by four support rods that are peripherally attached to the electrodes along the diagonals.

The present invention provides focusing electrodes that improve on the focusing electrodes disclosed in the above-cited patents by enlarging the recesses therein and by making the horizontal and vertical focusing fields more equal.

DETAILED DESCRIPTION OF THE PREFERRED EMBODIMENT

Figure 1:
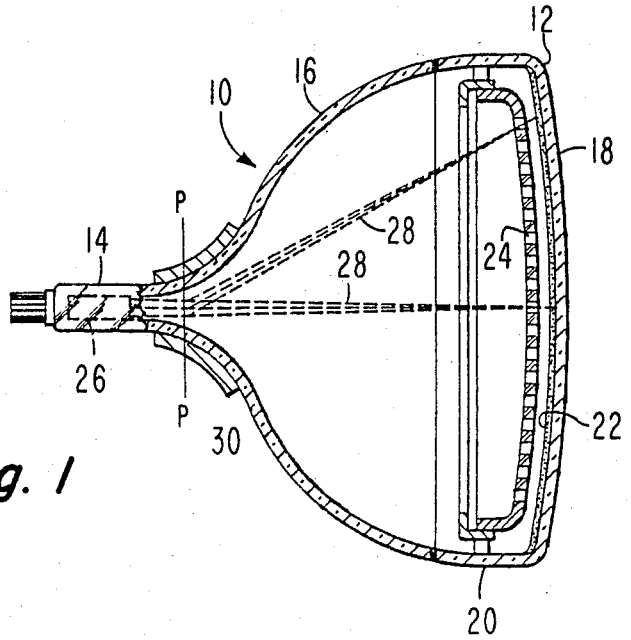
FIG. 1 is a plan view, partly in axial section, of a shadow mask color picture tube embodying the invention.

FIG. 1 shows a rectangular color picture tube having a glass envelope 10 comprising a rectangular faceplate panel 12 and a tubular neck 14 connected by a rectangular funnel 16. The panel 12 comprises a viewing faceplate 18 and peripheral flange or sidewall 20 which is sealed to the funnel 16. A mosaic three-color phosphor screen 22 is carried by the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1.

Figure 2:
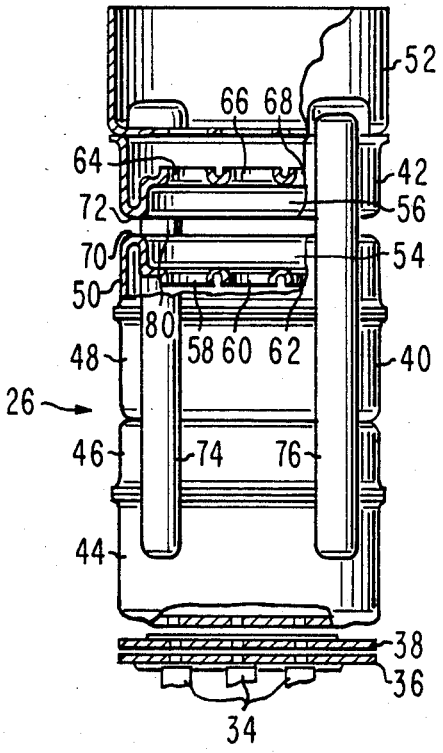
FIGS. 2 and 3 are partial axial section top and side views, respectively, of the electron gun shown in dashed lines in FIG. 1.
Figure 3:
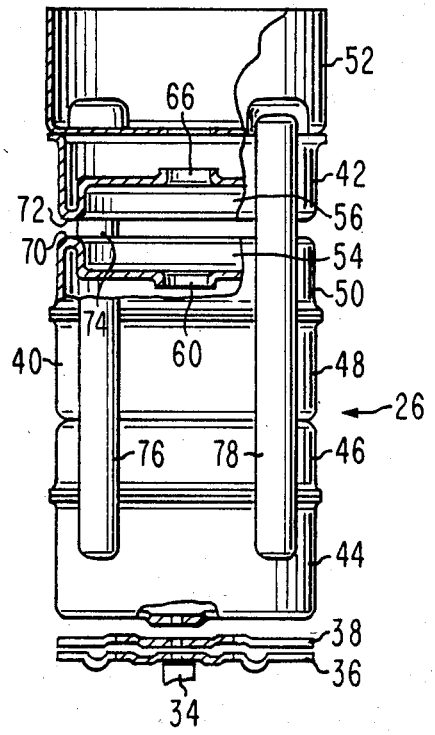

The details of the gun 26 are shown in FIGS. 2 and 3. The gun 26 comprises three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 4 is formed with four cup-shaped elements 44, 46, 48 and 50. The open ends of two of these elements, 44 and 46, are attached to each other, and the open ends of the other two elements, 48 and 50, are also attached to each other. The apertured closed end of the third element 48 is attached to the apertured closed end of the second element 46. Although the G3 electrode 40 is shown as a four-piece structure, it could be fabricated from any number of elements to attain the same length. The G4 electrode 42 also is cup-shaped but has its open end closed with an apertured shield cup 52.

The facing apertured closed ends of the G3 electrode 40 and the G4 electrode 42 have novel large recesses 54 and 56, respectively, therein. The recesses 54 and 56 set back the portion of the closed end of the G3 electrode 40 that contains three apertures, 58, 60 and 62, from the portion of the closed end of the G4 electrode 42 that contains three apertures, 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closest portions of the two electrodes 40 and 42 to each other.

The two accelerating and focusing electrodes 40 and 42 are connected by four electrically insulative support rods 74, 76, 78 and 80. The support rods are symmetrically positioned at about 90° intervals around the electron gun 26. The rods may extend to and support the G1 and G2 grid electrodes, 36 and 38, or these grid electrodes may be attached to the G3 electrode 40 by some other means. In a preferred embodiment, the support rods are of glass, which was heated and pressed onto claws extending from the electrodes, to embed the claws in the rods.

Figure 4:
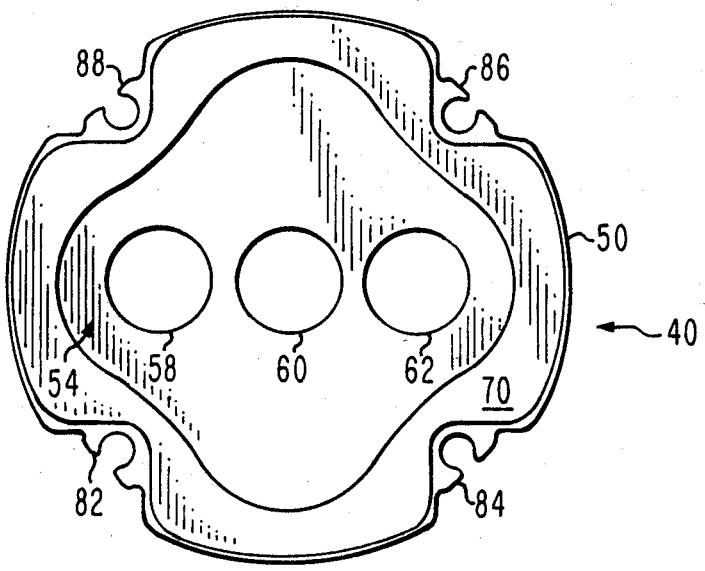
FIG. 4 is a front view of a focusing lens electrode of the electron gun of FIGS. 2 and 3.

Utilization of the four support rods 74, 76, 78 and 80 permits considerable enlargement of the recesses 54 and 56 in the focusing field electrodes 40 and 42, respectively, over that taught by the prior art. FIG. 4 shows a front view of the G3 electrode 40. The G4 electrode 42 may be identical or may vary to some extent to meet particular design requirements. For example, the width of the recess 56 in the G4 electrode 42, as viewed in FIG. 2, may be slightly wider than the width of the recess 54 in the G3 electrode 40 to aid in convergence of the electron beams. The radii of the sides of the recess 56 in the inline direction also may differ from the corresponding radii in the recess 54 to ensure stigmatic focusing of the outer beams or to introduce a desired amount of astigmatism into the focusing. The lengths of the recesses 54 and 56 in the direction perpendicular to the inline direction, and the radii of the recess sides in this direction, similarly may differ to provide proper astigmatism in the focusing of the center beam. Referring again to FIG. 4, the recess 54 in the G3 electrode 40 is substantially as wide in a direction perpendicular to the inline direction of the inline apertures 58, 60 and 62 as it is in the inline direction of the inline apertures. The enlarged recess 54 is made possible by locating four support claws 82, 84, 86 and 88 on the electrode 40 at the four indentations formed in the cruciform shape of the electrode. Because of the enlarged recess 54 in the G3 electrode 40 and the enlarged recess 56 in the G4 electrode 42, the respective rims 70 and 72 form an enlarged electrostatic focus lens which has less aberrations than do the lenses formed by the more elongated rims of the prior art designs.

Some typical dimensions for an electron gun, such as the electron gun 26 of FIGS. 2 and 3, are presented in the following table.

TABLE

| | |
|---|---|
| External diameter of tube neck | 29.00 mm |
| Internal diameter of tube neck | 24.00 mm |
| Minimum (i.e., rim-to-rim) Spacing between G3 and G4 electrodes 40 and 42 | 1.27 mm |
| Center-to-center spacing between adjacent apertures in G3 electrode 40 | 5.1 mm |
| Inner diameter of apertures 58, 60 and 62 in G3 electrode 40 | 4.1 mm |
| Maximum dimension of recess 54 in G3 electrode 40 | 19.0 mm |
| Diagonal dimension of recess 54 in G3 electrode 40 mm | 12.7 mm |
| Depth of recess 54 in G3 electrode 40 and of recess 56 in G4 electrode 42 | 2.92 mm |

Figure 5:
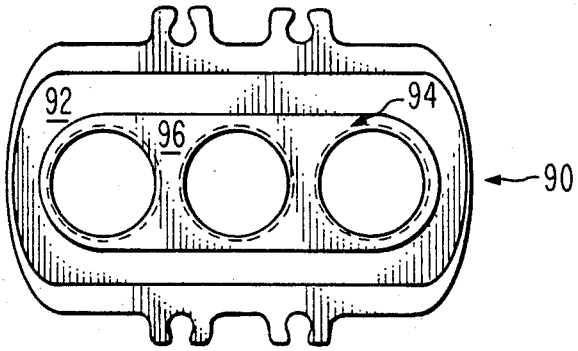
Fig. 5 PRIOR ART
FIGS. 5, 6 and 7 are front views of three different prior art focusing electrodes.
Figure 6:
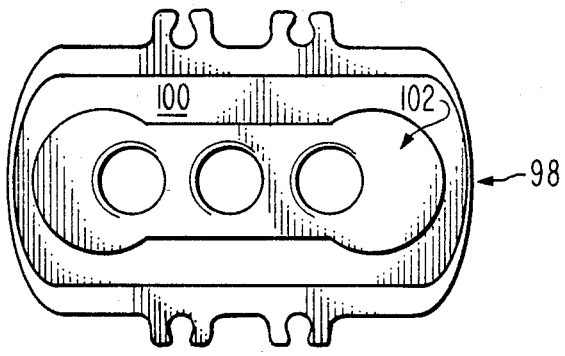
Fig. 6 PRIOR ART
Figure 7:
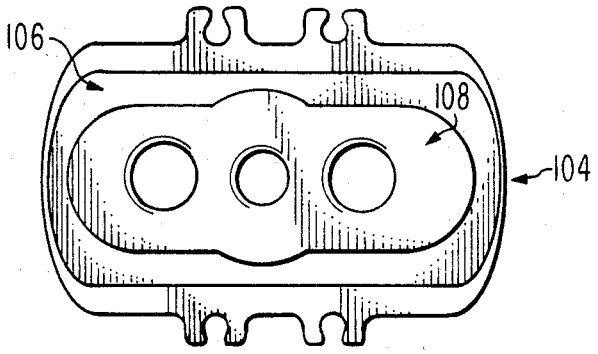
Fig. 7 PRIOR ART

FIGS. 5, 6 and 7 show three prior art focusing electrode designs previously discussed in the Background of the Invention.. A first electrode 90, shown in FIG. 5, is disclosed in above-cited U.S. Pat. No. 4,370,592. The electrode 90 includes a peripheral rim 92, and an elongated recess 94 which sets back an apertured portion 96 from the peripheral rim 92. The recess 94 includes two straight parallel portions and two curved side portions. As discussed in that patent, the design of the electrode 90 causes a slot astigmatism that must be corrected by other means in the electron gun.

A second prior art electrode 98, shown in FIG. 6, is disclosed in above-cited U.S. Pat. No. 4,388,552. The electrode 98 also includes a peripheral rim 100 and an elongated recess 102. However, in this design, the recess 102 is formed wider at side beam paths than at the center beam path, to at least partially compensate for the above-mentioned slot astigmatism.

A third prior art electrode 104, shown in FIG. 7, is disclosed in above-cited U.S. Pat. No. 4,400,649. The electrode 104 also includes a peripheral rim 106 and an elongated recess 108. In this electrode design, the width of the recess 108 is wider at the center beam path than at the side beam paths, and the center beam aperture is smaller than the side beam apertures, in order to minimize a horizontal and vertical focus voltage differential caused by the elongated shape of the recess 108.

All three of the above-described prior art electrodes include an elongated recess. The rims surrounding those recesses form the largest focusing lens that is practical utilizing the two support rod structures of the prior art.

Figure 8:
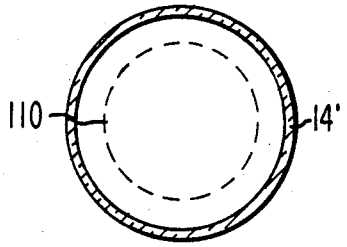
FIG. 8 is a cross-sectional view of a tube neck.
Figure 9:
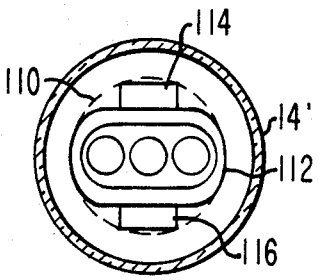
Fig. 9 PRIOR ART
FIGS. 9 and 10 are cross-sectional views of tube necks having prior art electron guns mounted therein.

The significance of the improved electrode structure can be appreciated by comparing FIGS. 8, 9, 10 and 11. FIG. 8 shows a cross-section of a tube neck 14'. The circular dashed line 110 within the neck 14' indicates a necessary limit on the diameter of an electron gun to maintain a minimum gun-to-inner wall spacing to prevent arcing therebetween. FIG. 9 shows the neck 14' with the focus electrode portion of one of the prior art electron guns 112 inserted therein. The gun 112 includes two support rods 114 and 116.

Figure 10:
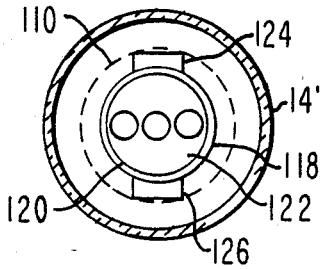
Fig. 10 PRIOR ART

FIG. 10 shows another type of electron gun 118 inserted into the neck 14'. This electron gun 118 is of the type disclosed in Japanese Utility Model OPI No. SHO 51-52668 which was opened to public inspection on April 21, 1976. Each of the focusing electrodes of the electron gun 118 includes a circular rim 120 and an apertured portion 122 set back from the rim 120. The major portion of the main focusing lens is formed by the rims 120. Although it may be thought that the circular configuration would provide the largest possible main lens, FIG. 10 shows that, because of the need for support rods 124 and 126, the diameter of the rim 120 must be limited.

Figure 11:
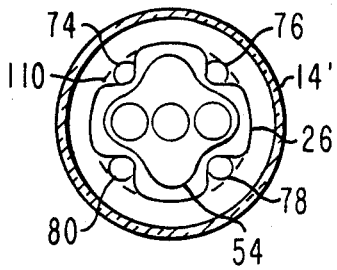
FIG. 11 is a cross-sectional view of a tube neck having an electron gun mounted therein that is constructed in accordance with the present invention.

FIG. 11 shows a focus electrode portion of the electron gun 26, constructed in accordance with the present invention, inserted in the neck 14'. Utilization of the cruciform structure along with the four, somewhat smaller, support rods 74, 76, 78, 80 permits the formation of a larger focusing lens, within the confines of the dashed line 110, than that possible with any of the above-mentioned prior art designs. In the foregoing example, the major portion of the focusing lens is formed by the facing rims 70 and 72 that surround the respective recesses 54 and 56. Because the recesses 54 and 56 in the focusing electrodes are enlarged, i.e. increased to 19 mm×19 mm from the 19 mm×7 mm of the FIG. 5 prior art, the electrostatic field lines of the focusing lens have much longer radii of curvature in the vertical direction. Thus the horizontal and vertical focusing actions of the focusing lens become more nearly equal.

What is claimed:

1. In a color picture tube having an inline electron gun for generating and directing three electron beams, a center beam and two side beams along coplanar paths toward a screen of said tube, said gun including a main focusing lens for focusing said electron beams, the main focusing lens being formed by two spaced electrodes each having three separate inline apertures therein, each electrode also including a peripheral rim, the peripheral rims of the two electrodes facing each other, and the apertured portion of each electrode being within a recess set back from the rim, the improvement comprising the recesses of said electrodes having substantially the same dimension perpendicular to the inline direction of the inline apertures as the dimension parallel to the inline direction of the inline apertures and having lesser dimensions along diagonals angled at approximately 45 degrees with respect to the inline direction of the inline apertures.

2. The tube as defined in claim 1, including four support rods peripherally attached to said electrodes along said diagonals.

3. In a color picture tube having an inline electron gun for generating and directing three electron beams, a center beam and two side beams along coplanar paths toward a screen of said tube, said gun including a main focusing lens for focusing said electron beams, the main focusing lens being formed by two spaced electrodes each having three separate inline apertures therein, each electrode also including a peripheral rim, the peripheral rims of the two electrodes facing each other, and the apertured portion of each electrode being within a recess set back from the rim, the improvement comprising the combination of said electrodes having a substantially cruciform shape and support rods attached to said electrodes at the indentations formed by the cruciform shape.

* * * * *